US007380286B1

(12) United States Patent
Bryant, Sr.

(10) Patent No.: US 7,380,286 B1
(45) Date of Patent: Jun. 3, 2008

(54) HEAD COVERING WITH UNOBSTRUCTED VISION

(76) Inventor: Frank D. Bryant, Sr., 2951 W. Gallaher Ferry, Knoxville, TN (US) 37932

( * ) Notice: Subject to any disclaimer, the term of this patent is extended or adjusted under 35 U.S.C. 154(b) by 465 days.

(21) Appl. No.: 11/018,291

(22) Filed: Dec. 21, 2004

Related U.S. Application Data

(60) Provisional application No. 60/621,556, filed on Oct. 22, 2004, provisional application No. 60/600,223, filed on Aug. 10, 2004, provisional application No. 60/532,138, filed on Dec. 23, 2003.

(51) Int. Cl.
*A42B 1/04* (2006.01)

(52) U.S. Cl. ..... 2/84; 2/202

(58) Field of Classification Search ..... 2/209.11, 2/209.12, 209.13, 175.6, 175.7, 195.4, 94, 2/101, 202, 422, 10, 84
See application file for complete search history.

(56) References Cited

U.S. PATENT DOCUMENTS

| | | | | | |
|---|---|---|---|---|---|
| 822,986 | A | * | 6/1906 | Rochet | 2/172 |
| 946,770 | A | * | 1/1910 | Sands | 2/68 |
| 1,525,322 | A | * | 2/1925 | Post | 2/84 |
| 1,980,394 | A | * | 11/1934 | Falcon | 2/98 |
| 2,055,560 | A | * | 9/1936 | Rose | 2/206 |
| 2,547,931 | A | * | 4/1951 | De Grazia | 2/84 |
| 3,203,003 | A | * | 8/1965 | Plastino | 2/422 |
| 4,180,868 | A | * | 1/1980 | Snow | 2/203 |
| 4,821,341 | A | * | 4/1989 | Baptiste | 2/10 |
| 4,980,928 | A | * | 1/1991 | Ellis | 2/88 |
| 5,046,195 | A | * | 9/1991 | Koritan | 2/172 |
| 5,081,717 | A | * | 1/1992 | Shedd et al. | 2/181.4 |
| 5,083,317 | A | * | 1/1992 | DeMoreta | 2/174 |
| 5,153,943 | A | * | 10/1992 | Clement | 2/418 |
| 5,161,719 | A | * | 11/1992 | Otteson et al. | 223/24 |
| 5,201,077 | A | * | 4/1993 | Dondlinger | 2/209.3 |
| 5,491,842 | A | * | 2/1996 | Braswell-Moore | 2/10 |
| 5,493,734 | A | * | 2/1996 | Nieves-Rivera | 2/209.13 |
| 5,560,043 | A | * | 10/1996 | Armstrong | 2/69.5 |
| 5,649,327 | A | * | 7/1997 | Crewe | 2/172 |
| 5,664,259 | A | * | 9/1997 | Budd | 2/115 |
| 5,685,017 | A | * | 11/1997 | Kraft | 2/171.1 |
| 5,694,647 | A | * | 12/1997 | Crickmore | 2/172 |

(Continued)

FOREIGN PATENT DOCUMENTS

| | | |
|---|---|---|
| DE | 3419160 | 11/1985 |
| JP | 2003089915 | 3/2003 |
| WO | WO 01/06882 | 2/2001 |

*Primary Examiner*—Alissa L Hoey
(74) *Attorney, Agent, or Firm*—Luedeka, Neely & Graham, P.C.

(57) ABSTRACT

A head covering system includes a hood connected to a head covering apparel by a fastening system so that the hood moves with the head and does not block side peripheral vision. In one embodiment fasteners are provided for connecting the hood to the bill of a cap. Such fasteners include snaps on the bill and the hood, or a hook and strap fastener that is positioned across the base of the bill proximate the users head. The hook and strap fastener may be detachably attached to the hood using fasteners such as snaps, or the strap may be an elastic strap permanently attached to the hood, preferably disposed between layers that form the top of the hood. A draw string cooperates with the fastening system to position the hood in a desired position and configuration.

1 Claim, 10 Drawing Sheets

U.S. PATENT DOCUMENTS 5,771,493 A * 6/1998 Proctor ..... 2/209.13
5,790,986 A * 8/1998 Hall ..... 2/172
5,862,523 A * 1/1999 Proctor ..... 2/209.11
5,875,493 A * 3/1999 MacDonald et al. ..... 2/172
5,896,587 A * 4/1999 Gentry ..... 2/425
5,901,380 A 5/1999 Mishal
5,950,241 A * 9/1999 Gomez ..... 2/172
6,009,555 A 1/2000 Siprut
6,023,787 A 2/2000 French et al.
6,029,278 A * 2/2000 Lopez ..... 2/209.13
6,049,904 A * 4/2000 Siracusa ..... 2/4
6,052,830 A * 4/2000 Payne ..... 2/171.1
6,131,201 A * 10/2000 Chu ..... 2/172
6,233,738 B1 * 5/2001 Siracusa ..... 2/4
6,237,162 B1 * 5/2001 Gill ..... 2/422
6,260,206 B1 * 7/2001 MacDonald et al. ..... 2/181
6,385,776 B2 * 5/2002 Linday ..... 2/171.1
6,463,592 B1 * 10/2002 Brooks ..... 2/209.12
6,546,559 B1 * 4/2003 Bronson ..... 2/12
6,718,559 B1 * 4/2004 Davidson ..... 2/422
6,808,146 B2 * 10/2004 Swan ..... 248/127
6,848,122 B1 * 2/2005 Meeds ..... 2/422
6,910,223 B2 * 6/2005 Egnew ..... 2/69
6,935,742 B1 * 8/2005 Wilson, Sr. ..... 351/155
6,996,852 B1 * 2/2006 Cabrera ..... 2/172
7,107,625 B2 * 9/2006 St-Germain ..... 2/209.13
7,240,372 B2 * 7/2007 Larson ..... 2/173
2001/0052144 A1 * 12/2001 Paris et al. ..... 2/171.3
2002/0108165 A1 * 8/2002 Porter et al. ..... 2/195.2
2003/0217405 A1 * 11/2003 Thompson ..... 2/209.13
2004/0154074 A1 * 8/2004 Yan ..... 2/209.11
2005/0066418 A1 * 3/2005 Duffy et al. ..... 2/175.7
2005/0188449 A1 * 9/2005 Larson ..... 2/209.11
2005/0241045 A1 * 11/2005 Tolton ..... 2/84

* cited by examiner

HEAD COVERING WITH UNOBSTRUCTED VISION

CROSS REFERENCE TO RELATED APPLICATIONS

This application claims the benefit of Provisional Application Ser. No. 60/532,138 filed Dec. 23, 2003 entitled "Head Covering Providing Unobstructed Side Views"; Provisional Application Ser. No. 60/600,223 filed Aug. 10, 2004 entitled "Head Covering with Detachable Fastener"; and Provisional Application Ser. No. 60/621,556 filed Oct. 22, 2004 entitled "Head Covering with Detachable Fastener", of which the teachings are incorporated herein.

FIELD

The present invention relates to head coverings and particularly relates to a head covering system that protects the head from wind and rain but allows unobstructed side views when the head is turned.

BACKGROUND

Head coverings often obstruct side views. For example, a hood attached to a jacket will either not turn or not turn completely with a turn of the head. Thus, when a person turns his head to the left and attempts to look left, the hood remains in its original position, or near to its original position, and obstructs the view to the left. This problem is illustrated in FIG. 1. A hood 20 is attached to a jacket 22 at the neck portion 24 of the hood. This particular hood 20 is designed to prevent rain and wind from striking the face 28 of the user. Thus, the hood 20 includes a bill-like extension 26 that extends outwardly from the top of the hood to protect the forehead and face 28 of the user. In this view, the user's face 28 is facing the left and the user is attempting to look to the left. However, the hood 20 has remained in a substantially forward facing position. Thus, one eye of the user is completely covered and the other eye is partially covered which obstructs the left view of the user.

The problem is particularly acute in jackets and coats designed for sportsmen such as fisherman, hunters, campers, hikers, etc. Typically the hooded jackets for sportsmen are designed to provide maximum protection in extreme conditions. Thus, the hood needs to protect the user's face by wrapping around the side of the face and extending beyond the face from above. In addition, to be comfortable, the hood should provide spacing between the user's head and the hood so that at least some ventilation around the hood is possible. Otherwise, the hood will cause condensation on eye glasses and will retain moisture that eventually will wet the head of the user. A relatively loose fitting hood 20 is more comfortable in the rain, because a tight fitting hood causes the user to actually feel raindrops on his head and neck. Also, a loose fitting hood is necessary to accommodate other head coverings that the user may wish to wear, such as a toboggan.

All of these advantages of a large relatively loose fitting hood create a corresponding problem. A large loose fitting hood exacerbates the problem illustrated in FIG. 1 where a user turns his face 28 to one side and the hood 20 blocks the view. Also, a large relatively loose hood provides the needed ventilation but it allows the hood to be blown from the user's head or be moved to an undesirable position. These problems are addressed by the present invention.

SUMMARY

In accordance with one embodiment of the present invention, a head covering is provided in which a hood is attached to a jacket and is configured to fit over the head and protect the top and sides of the head. A fastening system is provided on a top section of the hood which is located along the front top edge of the hood generally above the user's eyes. The head covering system also includes a cap that covers the user's head and includes a semi-rigid bill that extends outwardly from the cap, is designed to fit against the brow of the user and extends outwardly to shade the eyes of the user. A fastening system is provided on the base of the bill, which is the area of the bill proximate to the cap. In a most preferred embodiment, the fastening system on the bill is located approximately one quarter inch from the intersection of the bill and cap. The hood, the fastening system on the hood, the cap, the bill, and the fastening system on the bill are all configured and sized so that the cap will properly position the hood on the user's head.

To assemble the head covering system, the cap is placed on the user's head with the bill facing forward in a normal position. The fastening system on the hood is then connected to the fastening system at the base of the bill. Because of the aforementioned configurations, fastening the hood to the bill immediately positions the hood properly on the user's head relative to the user's face. Thus, regardless of the size of the user's head and regardless of the various adjustments that may be made to the hood, the cap will hold the hood in a proper position relative to the face so that the hood protects the user's face from rain and elements, but prevents the user's face from being unnecessarily obstructed. In particular, when a user turns his head to one side or the other, the cap and hood interact so that the top of the hood moves with the user's face and allows an unobstructed view of the side to which the head is turned. This advantage is best illustrated in the FIG. 2.

In one embodiment, the cap includes a headband that extends across the brow of the user and around the back of the head. The headband preferably includes an adjustment, such as a buckle and a strap, so that the size of the cap can be adjusted to fit snugly on the user's head. Thus, the cap will move with the user's head even though the hood will offer some resistance to left and right head movements. The headband ensures that the cap will move the hood and not vice versa.

Another embodiment of the fastening system for the hood and cap are snaps, where the snap on the hood is configured to mate with and snap to the snaps on the cap. It is preferred to use snaps on the base of the bill positioned on opposing lateral sides of the bill. Most preferably, the snaps are about ¼ inch from the lateral side of the bill and about ¼ inch from the base edge of the bill, which is positioned against the user's brow. The matching snaps that are positioned on the hood are spaced apart by the same distance as the spacing between the two snaps on the bill. When the hood snaps engage the bill snaps, the hood is stretched relatively tightly between the two snaps on the bill. When the head is turned to the left, the primary force is applied to the snaps on the right side, but the snaps on left side are also assisting with the movement of the hood because of the tension in the hood material between the two snaps as discussed above. Thus, both snaps function to pull the hood to the left and to the right. Since the hood has some stiffness, the snaps also operate to push the hood sideways.

Another embodiment of the fastening system allows a user to connect the hood to a cap of any description so long as it has a bill. This attachment system is also a temporary system whereby the cap retains no permanent markings after use of the system. The device is configured to temporarily attach male snaps to the top portion of a bill on a cap. Preferably the male snap portions are located near the base of the bill and also near the outside edges of the bill. The device most preferably includes an elastic band with clips on opposite ends of the band. The male portions of the snaps are mounted on the elastic band near the clips. To place the snaps on a cap, one clip is secured to the edge of the bill near the base of the bill. The elastic band is then stretched across the top of the bill adjacent the base of the bill and the opposing snap is secured to the opposite edge of the bill, again, near the base of the bill. Once attached, the elastic band provides two male snap portions that will attach to the female snap portions that are mounted on the hood.

In another embodiment, the fastening system allows a user to strap a cap of any size in to the hood of the jacket using a permanent attachment system. The permanent attachment system is comprised preferably of an elastic band disposed between the inner and outer layers of the hood with its two ends protruding through two holes in the inner hood such that the outer layer of the hood shows no portion of the system. The ends of the elastic strip have two hooks which may be stretched over the edges of the cap. Other embodiments include sleeves around the strip in order to reduce hood bunching, lines of stitching to ensure the permanent attachment system does not slide within the hood, or non-elastic, adjustable strips installed in a similar fashion as the elastic system.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
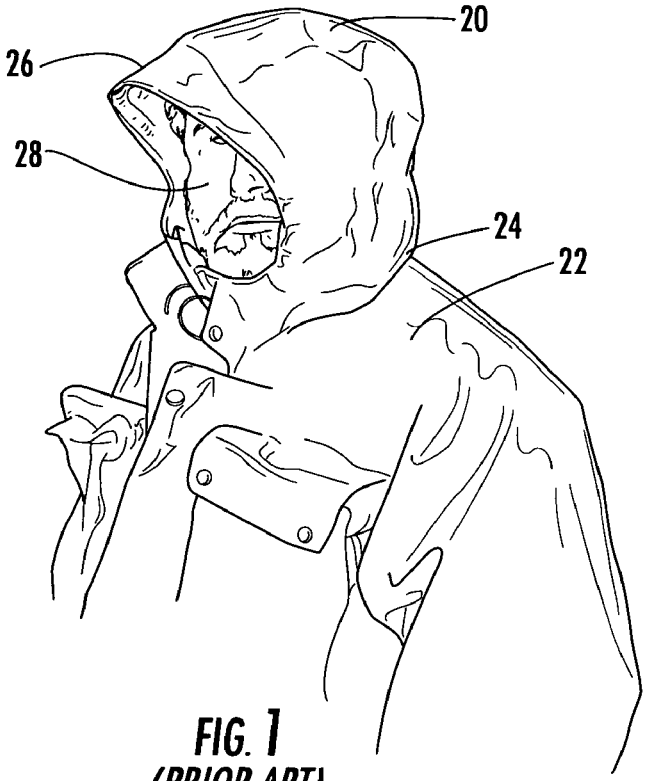
FIG. 1 (PRIOR ART)
FIG. 1 is an illustration of a prior art design showing the hood in a position that obstructs the user's view to the left.

Referring now to the drawings in which like reference characters disclose like or corresponding parts throughout the several views, a prior art hood 20 is shown in FIG. 1. The hood 20 is attached to a jacket 22 at the neck portion 24 which tends to hold the hood 20 in a face forward position. Thus, when a person rotates his face 28 to the left, the head rotates within the hood 20 which stays in approximately the same position because of the connection to the jacket 22. As used herein, "hood" means a head covering that is attached to the neck of a jacket. Thus, when a person looks to one side as shown in FIG. 1, the hood 20 obstructs the view. This effect is exacerbated when large loose fitting hoods are used and is further exacerbated by hoods that have bill-like extensions 26 formed along the top of the hood and for shading the eyes and protecting the face from rain. This extension of the hood wraps around the face and tends to obstruct left and right views.

Figure 2:
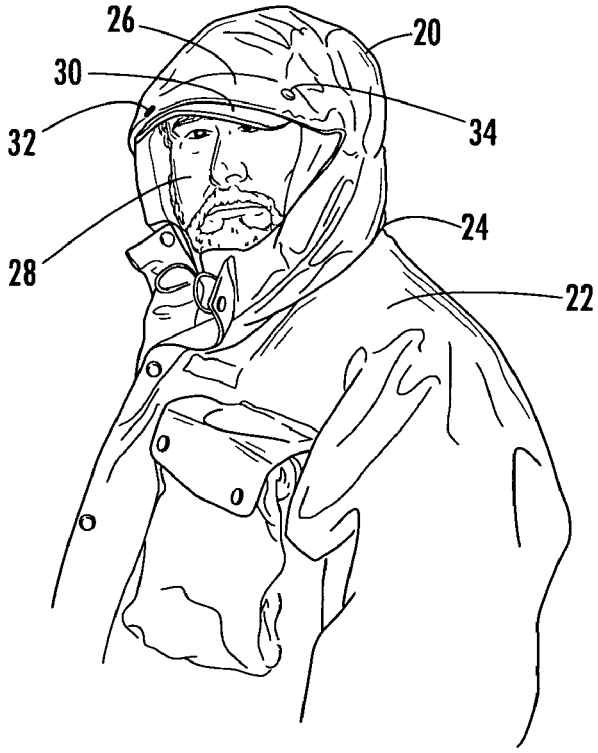
FIG. 2 is an illustration of the present head covering system in which a cap is snapped to the hood and provides a view to the left that is unobstructed.

FIG. 2 illustrates a hood constructed in accordance with the present invention. As before, the hood 20 is connected to the jacket 22 at a neck portion 24. In this head covering system, the user is wearing a cap 36 with a bill 30 extending out from beneath the hood 20. Snaps 32 and 34 are attached to the hood 20 permanently and snap to the base 44 of the bill 30. In this arrangement, when the user turns his face 28 to the left or right, the bill 30 rotates with the user's face 28, and the snaps 32 and 34 cause the hood 20 to also rotate, or to twist partially, in conformity with the movement of the bill 30. Thus, as illustrated in FIG. 2, the bill 30 and the snaps 32 and 34 function to move the hood 20 so that the user's view is not obstructed to the left or the right.

Figure 3:
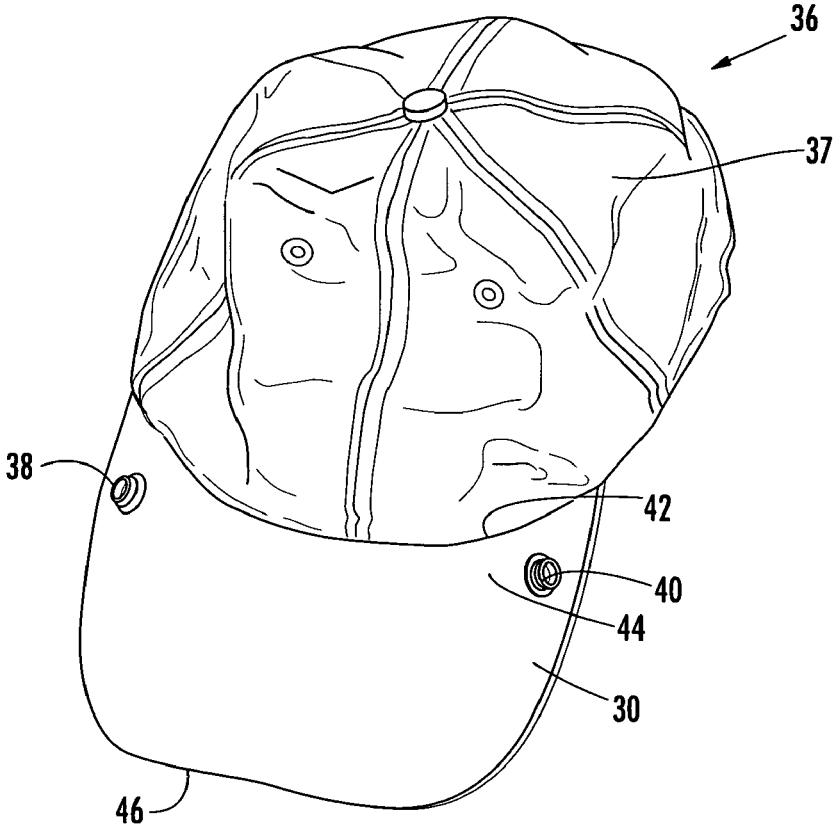
FIG. 3 is a top view of a cap and snaps combination used in the present invention.

In FIG. 3, a cap 36 is shown that corresponds to the cap that the user is wearing in FIG. 2. The cap 36 includes a skull covering portion 37 that generally fits over the head of the user. The bill 30 extends outwardly from the skull covering portion 37 and snaps 38 and 40 are formed proximate the lateral sides of the bill 30, and snaps 38 and 40 are permanently attached to the bill 30 at the base 44 of the bill 30, which is proximate to the base edge 42 of the bill 30. In use, the base edge 42 fits snugly against the user's forehead. In this embodiment, the snaps 38 and 40 are positioned approximately one quarter to one half inch from the lateral edges of the bill 30 and approximately one quarter to one half inch from the base edge of 42.

Referring to FIGS. 2 and 3, the interaction between the hood 20 and the cap 36 is better appreciated. First, it is noted that the snaps 38 and 40 are configured to snap into the snaps of 32 and 34, respectively. As shown, the snaps 38 and 40 have projections that fit into and snap into receivers in the snaps 32 and 34. Preferably, the snaps are made of a lightweight material such as nylon, but they could also be made of metal such as stainless steel, brass or aluminum.

The snaps are designed to have only moderate holding power so that they can be easily snapped and unsnapped by a user without deforming the bill 30 or deforming or ripping the hood 20. Since the primary forces applied to the snaps 32, 34, 38 and 40 are lateral forces (perpendicular to the snapping direction) the forces do not work to open the snaps. Thus, even though little force is required to snap or unsnap these devices, they will carry significant lateral loads, certainly enough to move the hood 20 to the left and right and clear the user's view.

Referring to FIGS. 2 and 3, it will be appreciated that the snaps 32 and 34 are placed in the hood 20 at a spacing that is approximately equal to the spacing between the snaps 38 and 40 in the cap 36. Preferably, the snaps 32 and 34 are spaced so that there is a slight tension in the hood material between the snaps 32 and 34 when they are attached to the snaps 38 and 40. Thus, when lateral forces are applied by the hood to one of the snaps 32 and 34, the tension in the hood fabric between the snaps will help transfer the force to both of the snaps of 32 and 34 and consequently will apply lateral forces to both snaps 38 and 40. Therefore, snaps 38 and 40 are both applying forces to the hood, and vice versa, to ensure that the hood moves with the user's head.

The placement of the snaps 38 and 40 near the base edge 42 of the cap 36 enables easy transfer of forces between the cap 36 and the hood 20. While the bill 30 is helpful in moving the hood 20, it also acts as a lever arm in favor of the hood 20 against the cap 36. Thus, for example, if the snaps 38 and 40 were placed near the outer edge 46 of the bill 30, the distance between the outer edge 46 and the base edge 42 would function as a lever arm assisting the hood 20 in trying to twist the cap 36 on the user's head. Thus, it is advantageous to place the snaps 38 and 40 as near as practical to the base edge 42 of the bill 30. By placing the snaps 38 and 40 near the base edge 42, the mechanical advantage of the hood 20 is minimized, and the hood 20 may be rotated or twisted by the cap 36 with a minimum effort on the part of the user and a minimum of twisting force on the cap.

Figure 4:
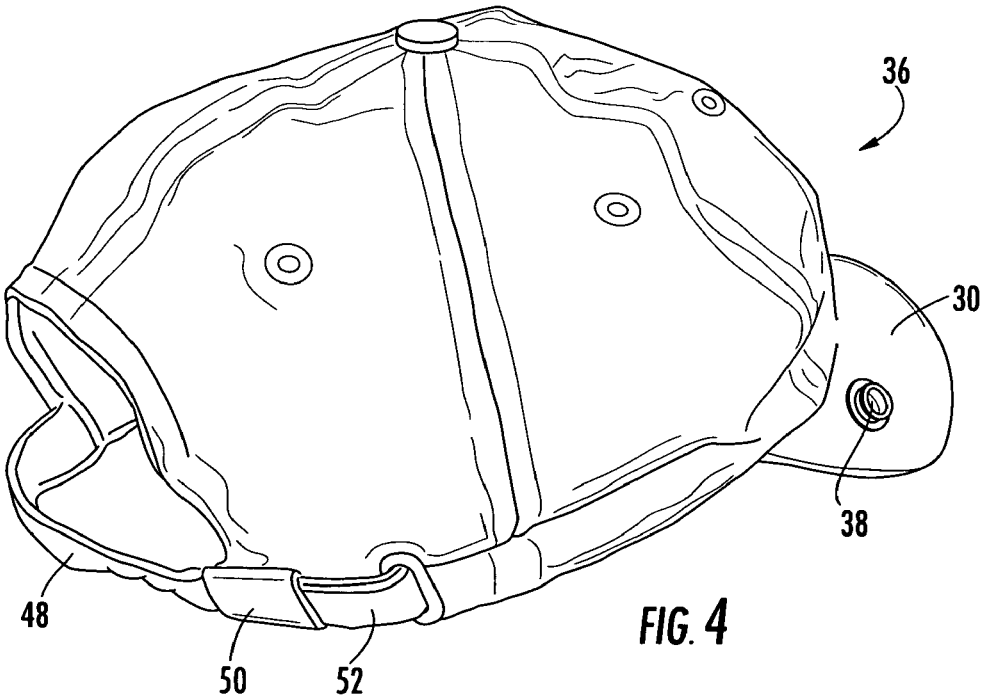
FIG. 4 is a perspective side rear view of the cap used in the present invention.

Referring to FIG. 4, a rear side perspective view of the cap 36 is shown. An adjustable band 48 is connected by a buckle 50 to a headband 52 that extends generally around the forehead and head of the user. The buckle 50 is provided to adjust the length of the band 48 and thereby adjust the overall length of the combination of the bands 48 and 52. With the buckle 50, the user may adjust the tightness of the cap to precisely fit the user's cap size. It is important that the cap 36 fit relatively snugly around the user's head so that the cap will not twist when it is turned sideways. Instead, it will rotate the hood 20 as shown in FIG. 2. Likewise, a snug fit of the cap 36 on the user's head will prevent the cap and the hood from blowing off of the user's head.

Figure 5:
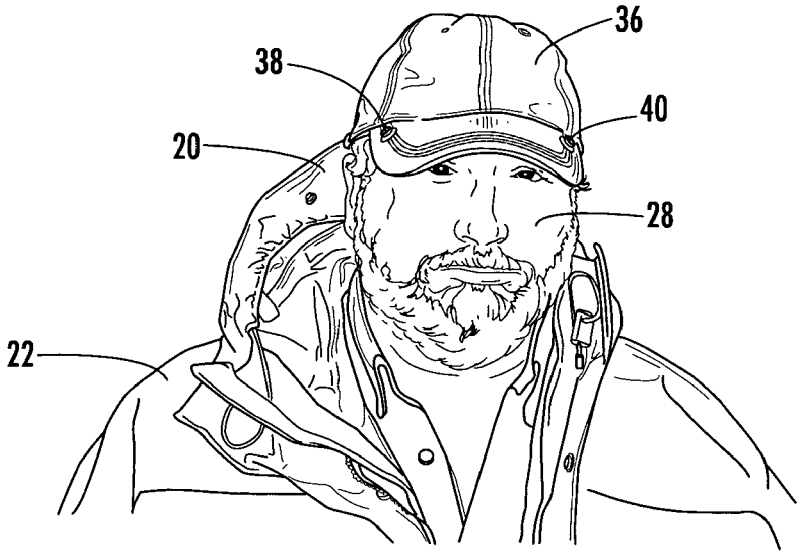
FIG. 5 shows a user of the head covering system with the cap positioned on the head and the hood in a stored position off of the head.
Figure 6:
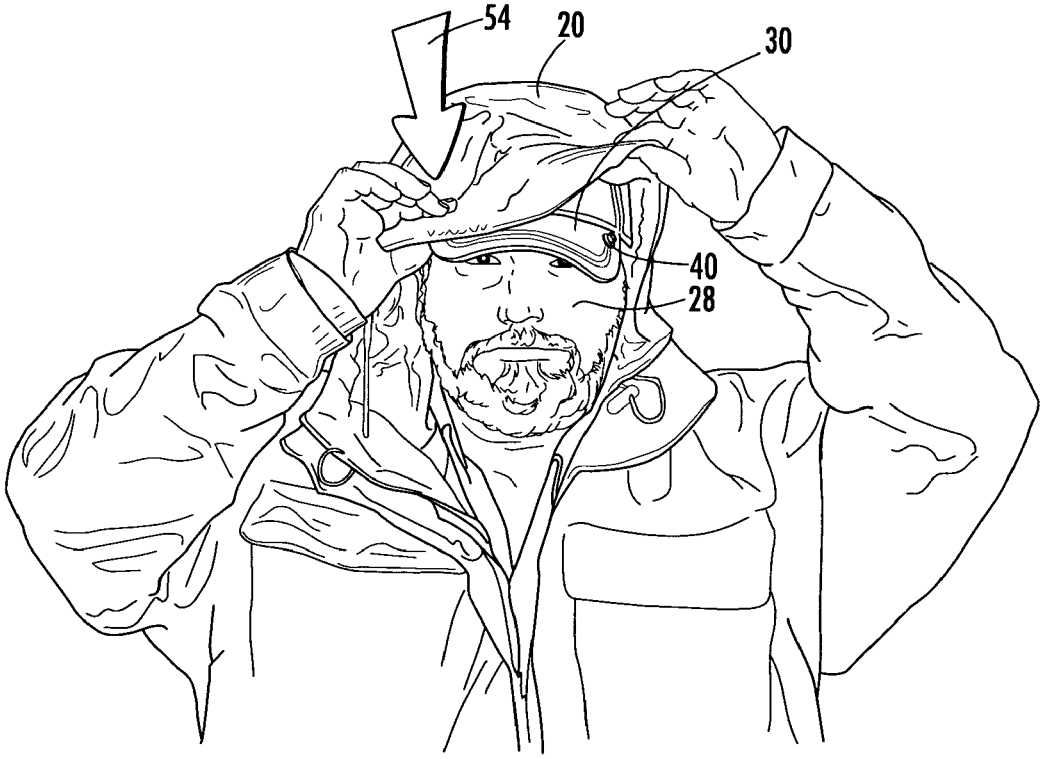
FIG. 6 shows the user positioning and attaching the hood to the cap on his head.

As shown in FIG. 5, the cap 36 may be worn by the user with the hood 20 completely removed from the user's head. By simply unsnapping the snaps 38 and 40 from the receiving snaps 32 and 34, the hood is released from the cap 36 and may be moved to a non-use position as shown in FIG. 5. Thus, a fisherman, for example, can quickly remove the hood when it is no longer raining. If it starts to rain again, the fisherman can quickly replace the hood by simply pulling the hood back over his head and snapping the hood 20 to the bill 30 as shown in FIG. 6. The motion of moving the hood 20 over the head and snapping the hood 20 to the bill 30 is indicated by the arrow 54.

The snaps 32 and 34 are positioned on the hood 30 so that the act of snapping the hood 20 to the bill 30 will place the hood 20 in a proper position with respect to the face 28 of the user. To perform its function properly, a hood 20 should extend outwardly away from the face 28 and be suspended above the face 28 to protect the user from falling and blowing precipitation. However, the user's face 28 should not fall too far back into the hood 20 because the user's view will then be obstructed. In fact, the hood 20 could fall down over the eyes of the user and prevent the user from looking forward. By snapping the hood 20 to the bill 30, the hood 20 is positioned correctly with respect to the face and it is prevented from dropping down over the eyes of the user. Likewise, it is prevented from slipping too far back on the user's head and allowing the user's face 28 to be exposed to the elements.

While the hood 20 provides rain protection and shading for the eyes, the bill 30 also provides rain protection and shading. In addition, it helps the hood 20 to maximize its protection by holding it out from the face to some extent and allowing it to protect the face from both falling rain and sideways blowing rain.

Figure 7:
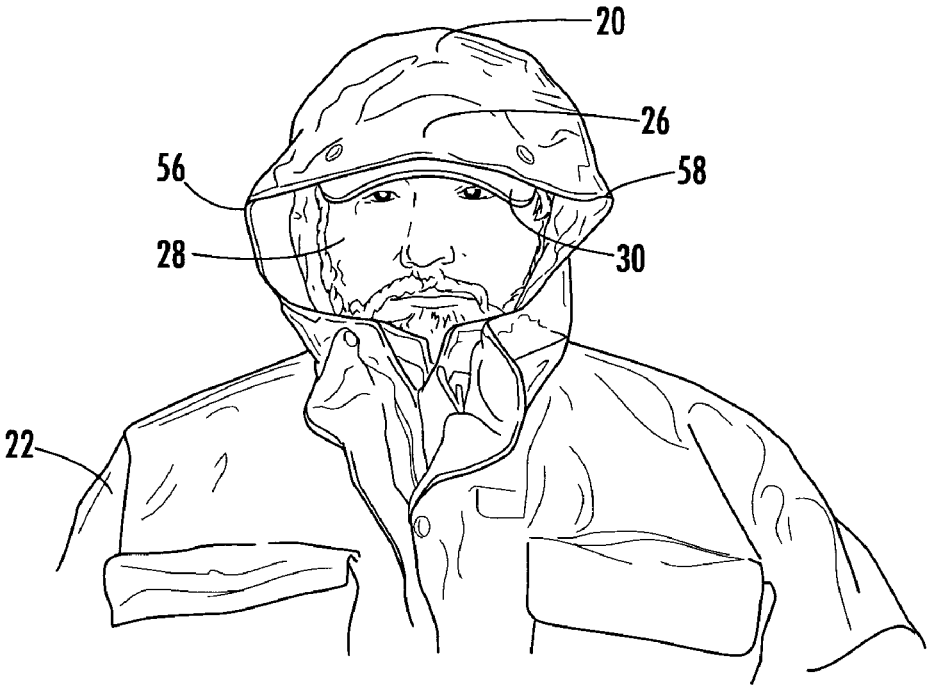
FIG. 7 shows a front view of the head covering system with the hood and cap positioned on the user's head in a maximum protection position.
Figure 8:
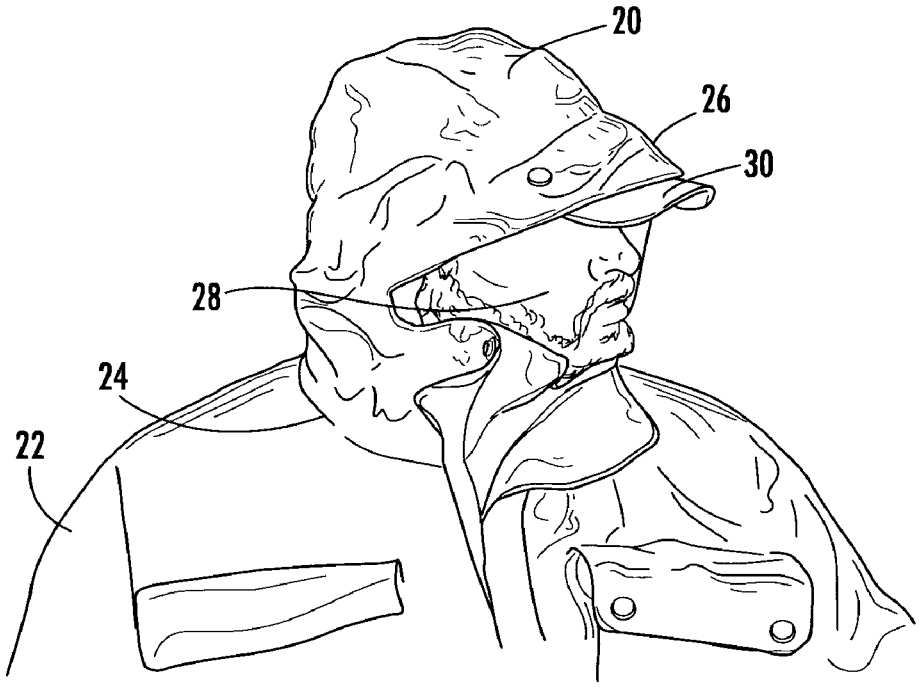
FIG. 8 is an illustration of a user turning his head to the left while wearing the head covering system of the present invention.

FIGS. 7 and 8 illustrate the hood 20 being used in a maximum protection configuration. This illustration, particularly FIG. 7, also illustrates how the bill 30 of the cap 36 operates to correctly position the hood 20 with respect to the user's face 28. The bill 30 supports the hood 20 in front of the user's face 28 in a tent-like structure. Wing 56 and 58 are formed on the outer sides of the hood 20 so that the face 28 is separated from the hood 20 but is also protected by the bill 36 with a minimum of obstruction in view. As illustrated by FIG. 8, when the user turns his head, the face 28 is still significantly protected by the twisting hood 20. If the hood 20 did not twist with the bill 30, the face 28 would be even more exposed than that shown in FIG. 8. Therefore, the hood 20 and cap 36 system of the present invention not only prevents obstructed views but it causes the hood 20 to protect the face 28 better and separate the face 28 from the hood 30 in a way that maximizes both protection and comfort.

In alternate embodiments, different fasteners can be used to attach the bill 30 of cap 36 to the hood 20. For example, patches of Velcro could be substituted for the snaps 32, 34, 38, and 40. Likewise, fasteners such as button and eye fasteners or hook fasteners could be used. The adjustment mechanism on the bands 48 and 52 could be other adjustment type mechanisms, such as a series of snaps, an elongated Velcro closure, or even an elastic type band.

In yet another embodiment of the invention, the cap 36 may be permanently attached to the hood 20. For example, the bill 30 could be permanently riveted to the hood 20, or the skull covering portion 37 could be sewn to the hood 20. Most preferably, the sewing line would extend through the skull covering portion 37 adjacent to and along the base edge 42 of the bill 30. In a different embodiment, the bill 30 could be provided by a visor structure that includes a headband or head clamp to secure the visor and bill 30 to the head. Where the bill 30 is permanently attached to the hood 20, it is not as necessary to have a cap 36 that covers the head and a visor or visor like structure would be appropriate.

In yet another embodiment, the snaps or other fasteners may be placed on the skull covering portion 37 of the cap 36, preferably near the brow of the user In one embodiment, the snaps 38 and 40 are on the skull portion 37, and there is no bill 30. In another embodiment, the snaps 38 and 40 are on the skull portion 37 and the cap 36 includes a bill 30 as best shown in FIGS. 3 and 4.

FIGS. 9-15 illustrate another embodiment of the invention: a temporary attachment system 100. The bill 30 of the cap 36 protrudes slightly from underneath the hood 20. The hood 20 is attached to the jacket 22 at the neck portion 24. On the top of the hood is a vertical adjustment strap 72 and a buckle 70 used for adjusting the strap 72. Also shown on FIGS. 11-15 is the horizontal adjustment drawstring 74, which may be located easily based on the location of the horizontal wrinkle 76 approximately half way from the neck portion 24 to the vertical strap buckle 70. The horizontal drawstring 74 is preferably adjusted by means of a drawstring clasping mechanism 78. The preferred embodiment of the temporary attachment system 100 consists of an elastic band 80 so that the system 100 fits securely onto the bill 30 of caps 36 of various sizes.

Figure 9:
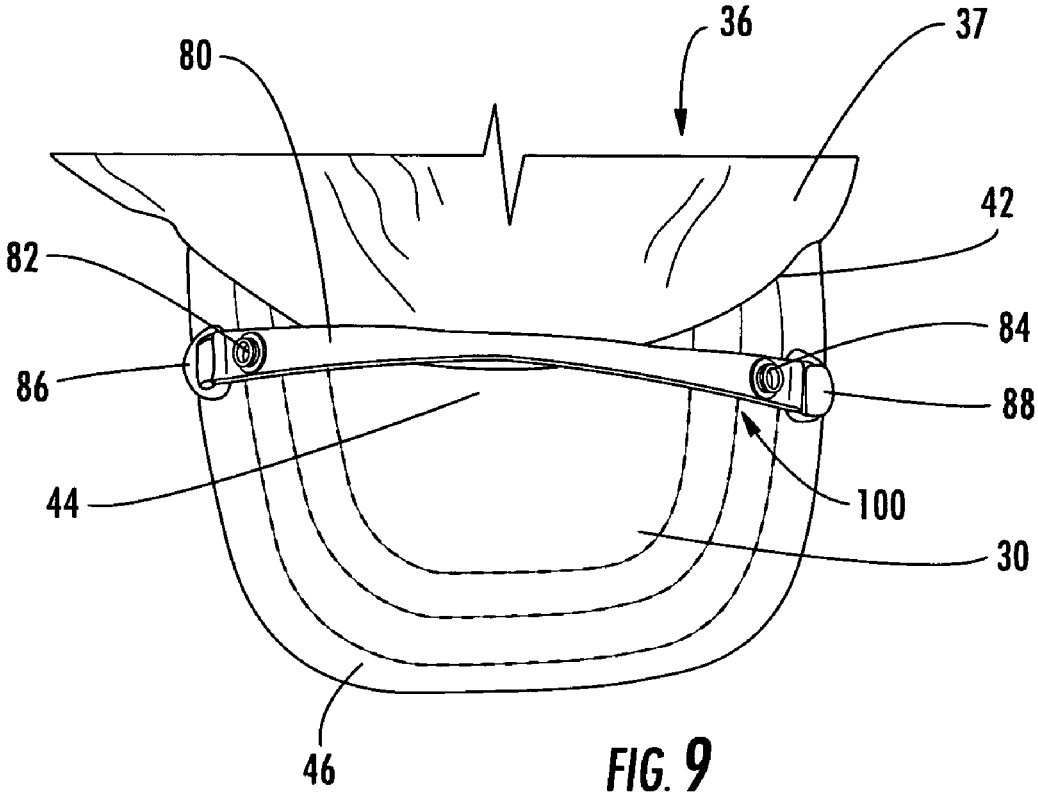
FIG. 9 is a close-up front view of the cap with the temporary attachment system in place.

FIG. 9 illustrates a close-up overhead view of the cap 36 with the temporary attachment system 100 installed on the bill 30 of the cap 36. The attachment system consists of the elastic band 80, two male snaps 82 and 84, and two hooks 86 and 88. The system 100 is installed on the base 44, close to the base edge 42 of the bill 30. The male snap 84 is positioned in close proximity to the hook 88, which is hooked over the outer edge 46 of the bill 30 of the cap 36. This installation results in the hood 20 being positioned farther back on the head of the wearer. The system 100 may also be installed closer to the outer edge 46 of the bill 30. When the hood 20 is attached to the system 100 in this configuration, the hood 20 would be positioned in a more forward position on the wearer's head. Thus, the position of the hood 20 may be controlled by the position of the attachment system 100. This is an additional benefit over the stationary permanent attachment system described in the embodiment above.

Figure 10:
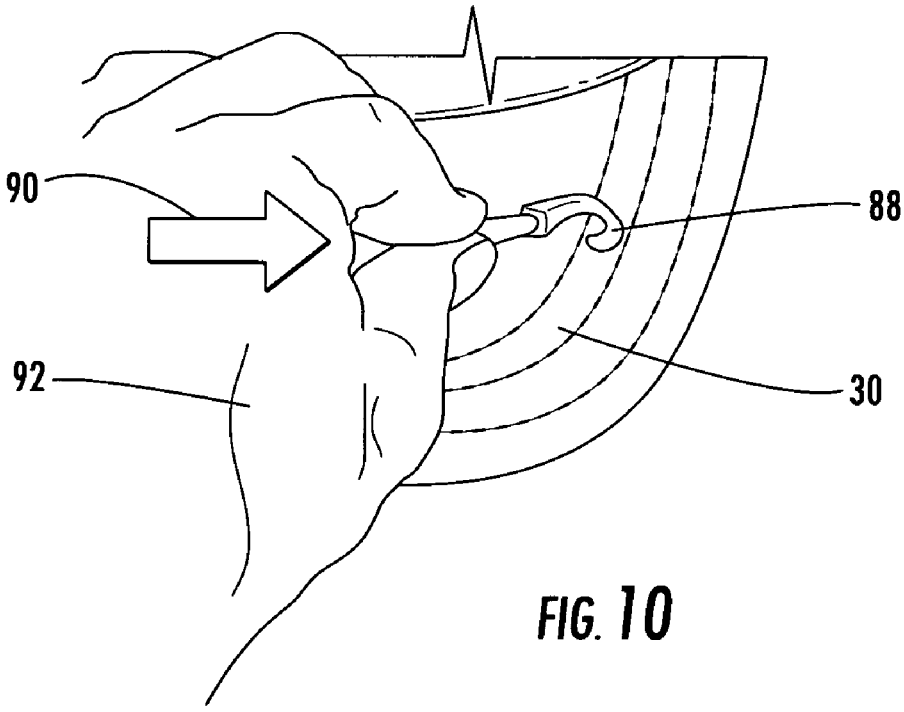
FIG. 10 is an illustration of the temporary attachment system being installed on the cap.

FIG. 10 illustrates the temporary attachment system 100 in an installation phase. In the figure, the first hook 86 has already been positioned over the outer edge 46 of the bill 30, and the attachment system 100 is being stretched across the width of the bill 30. The directional arrow 90 shows the direction the hand 92 is moving in order to secure the second hook 88 over the outer edge 46 opposite the first hook 86.

Figure 11:
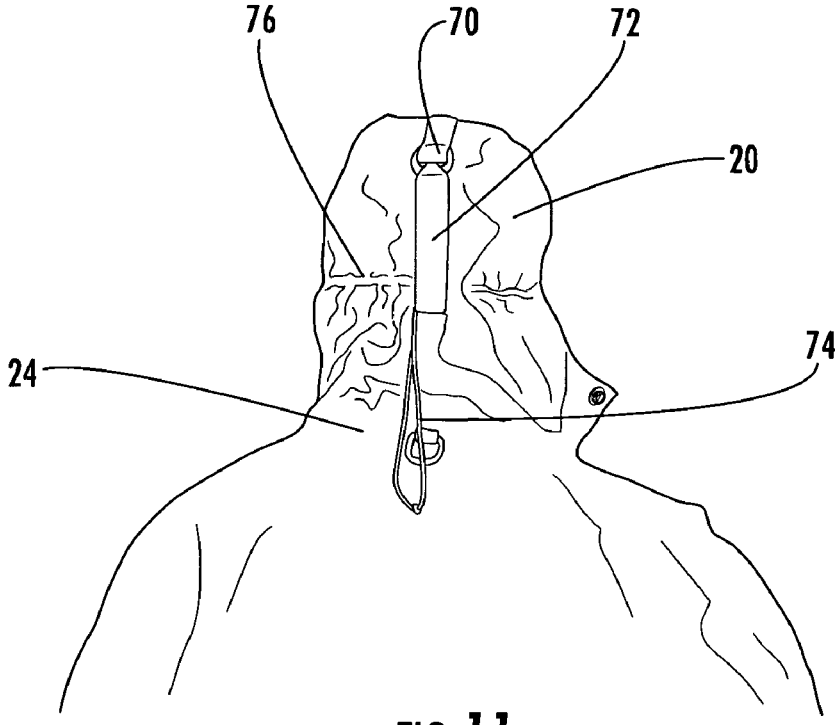
FIG. 11 is a rear view of the hood in a use position with the horizontal and vertical straps tightened.
Figure 12:
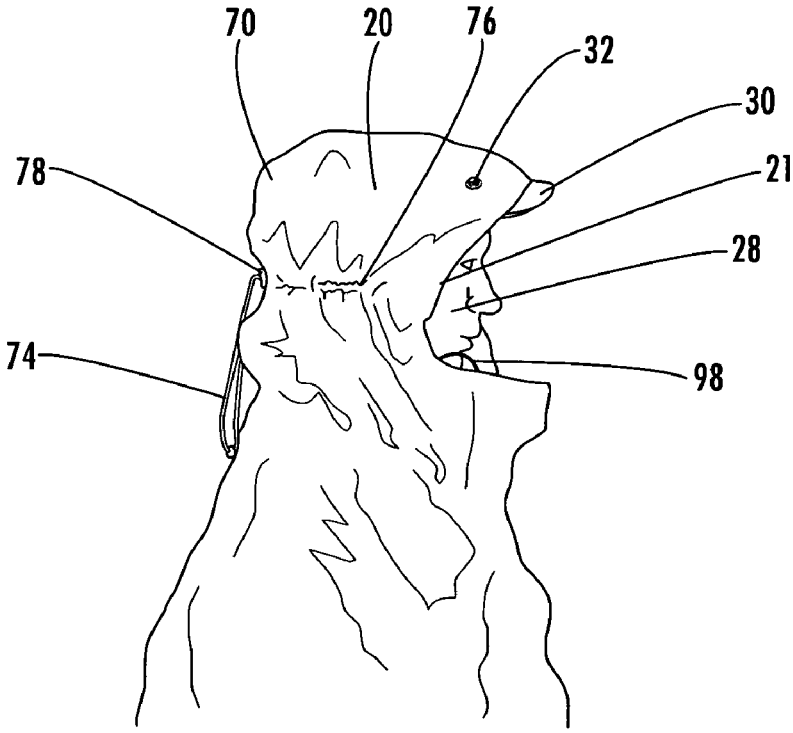
FIG. 12 is a side view of the hood in a use position with the horizontal and vertical straps tightened.
Figure 13:
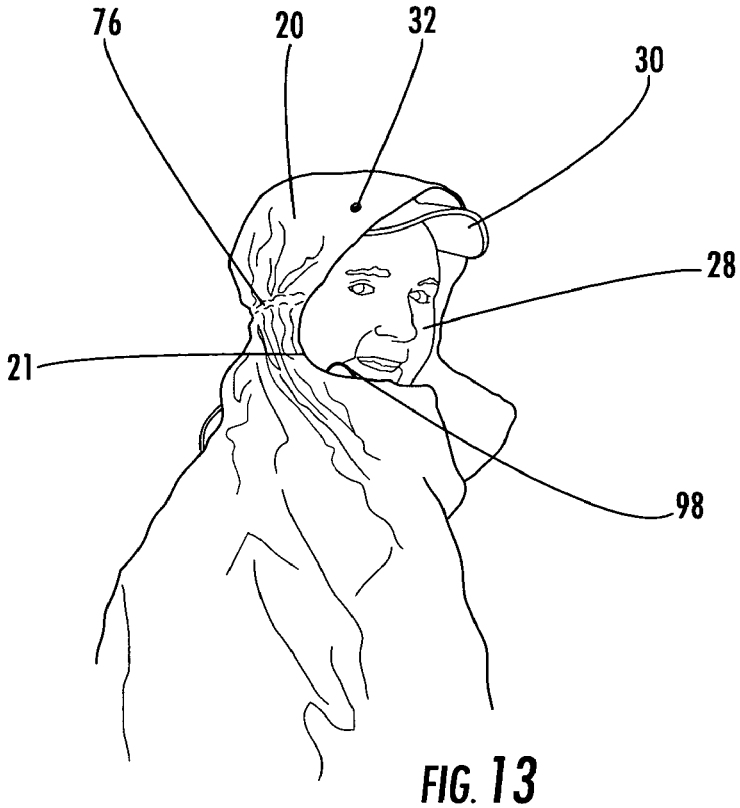
FIG. 13 is a side view of the hood in a use position with the horizontal and vertical straps tightened and the head turned to the side.

FIG. 11 further demonstrates the invention. The temporary attachment system 100 is installed on the bill 30 of the cap 36 and the hood 20 is connected to the attachment system 100 by means of female snaps 32 and 34 located on the hood. These snaps mate with the male snaps 82 and 84 respectively to form a strong coupling. This coupling is strong enough to hold the hood 20 to the cap 36 when the wearer's head 28 moves from side to side, but is weak enough to release when stress sufficient to tear or disfigure the hood material is exerted on the coupled snaps. Also, both the vertical strap 72 and the horizontal drawstring 74 are tightened such that the hood 20 gently conforms to the wearer's head. This positioning of the hood 20 is useful for various outdoor activities where less facial protection and increased visibility are required. FIG. 12 shows a side view of the same configuration shown in FIG. 11 with the wearer's face 28 looking directly forward. FIG. 13 shows the same configuration shown in FIGS. 11 and 12 with the wearer's face 28 turned to the side. As shown in FIG. 13, the present invention allows for a full range of vision even while the wearer's face 28 is turned to the side.

Shown in FIGS. 12-15, drawstring 98 is positioned around the front edge 21 of the hood. The drawstring combination allows for protection from rainfall while also providing the widest possible visible range. If the temporary attachment system 100 was not used to secure the hood on the bill 30 of the cap 36, the tightened strap 72 and drawstrings 74 and 98 would pull the hood 20 away from the face of the wearer's head 28. Thus, the combination of the attachment system 100, the straps and drawstrings allow a unique combination of weather protection and wide line of sight, which would otherwise be impossible.

Figure 14:
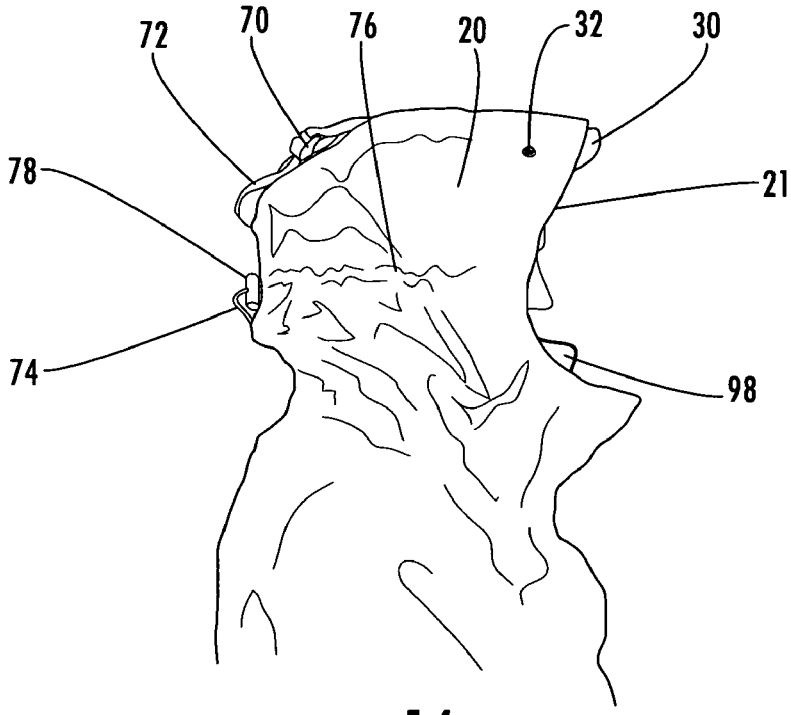
FIG. 14 is a side view of the hood in a use position with straps loosened.
Figure 15:
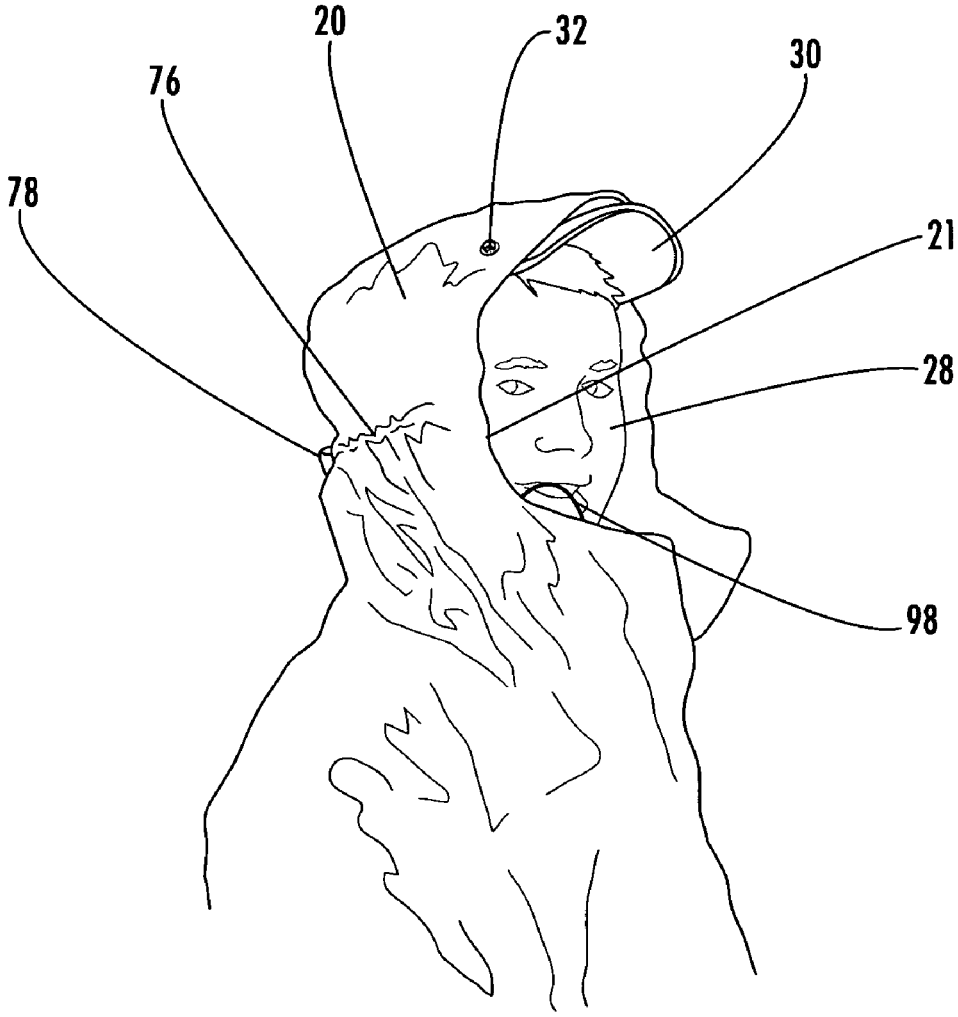
FIG. 15 is a side view of the hood in a use position with straps loosened and the head turned to the side.

Alternatively, in FIGS. 14 and 15, the vertical strap 72 and the horizontal drawstring 74 are in the loosened position, allowing increased air circulation between the hood 20 and the wearer's head 28. This provides more facial protection, which is beneficial during sports such as fly-fishing. When the strap 72 and drawstring 74 are loose, the hood 20 would ordinarily be free to fall forward well beyond the user's face 28. In this extreme forward position, side and upward view is maximally obstructed and the hood 20 could fold inwardly to obstruct all or part of the forward view. However, by means of the temporary attachment system 100, the hood is held in a stable position relative to the wearer's face 28 and view obstruction problems are eliminated or reduced.

FIG. 14 illustrates the side of the hood 20 with both the vertical strap 72 and the horizontal drawstring 74 in loosened positions. In this position, the vertical buckle 70 rests behind the hood 20 and the drawstring clasping mechanism 78 rests near the end of the horizontal drawstring 74.

Another variation of the invention concerns the configuration of the hood 20. The hood 20 configuration and the cap 36 and snap configuration are cooperative. Specifically, the cap 36 and hood 20 are designed to position the edge 21 of the hood 20 around the user's face 28 precisely. For example, in a fly-fishing hood, it is preferred to position the outer side edges of the hood 20 slightly forward of the user's face 28, such as one quarter-inch forward of the user's face 28. The upper edge of the hood 20 is preferably more forward of the user's face 28, for example two inches forward of the forehead. In this way, the hood 20 protects the user's face 28 from above and from the side, and the cap 36 maintains the position of the front edge 21 of the hood 20. The positioning of the outer edge of the hood 20 is accomplished by the placement of the snaps (32, 34 and 82, 84 respectively) on the hood 20 and on the bill 30 of a cap 36. In other words, suppose the snaps are placed on the bill 30 of the cap 36 at a position that is approximately one half-inch in front of the user's forehead. To achieve a two inch overhang of the hood 20 in front of the user's face 28, the snaps are placed approximately one and three-quarters inches from the outer edge of the hood 20, and the edge of the hood 20 is configured to extend substantially vertically downwardly from the snap positions on the bill 30. Thus, the user's face 28 is protected by a 2 inch overhang from above. In other embodiments where protection is more important or less important, the overhang may be decreased or increased, respectively. In either case the positioning of the hood 20 depends on the hood's configuration and the position of the snaps on the hood 20 and the bill 30 of the cap 36.

One variation of the temporary attachment system 100 is a band 80 dimensioned to fit securely and snugly across the bill 30 of the cap 36, where the band 80 is non-elastic. Another variation is a band 80 adjustable in length by means of some type of fastener mechanism such as Velcro, snaps, buckles or the like. The band 80 could also be made of a rigid material with adjustable hooks 86 and 88, which are movable along the longitude of the band 80.

Yet another alternative would be a configuration in which the male portions of the snaps 82 and 84 were mounted on the hooks 86 and 88 themselves. In this configuration, the hooks 86 and 88 would extend along the top edge of the bill 30 of the cap 36 for a distance sufficient to allow the male snaps 82 and 84 to be positioned on the bill 30 in a desired location when the hooks 86 and 88 are positioned on the bill 30. In this configuration, the hooks 82 and 84 would secure themselves to the bill 30 of a cap 36, but once the hood's 20 female snaps 32 and 34 were attached to the male snaps 82 and 84, the material of the hood 20 would function somewhat like the elastic band 80 of the attachment system 100. In other words, once the hood 20 is attached to the cap 36 by snaps 82 and 84, the hood 20 would prevent the coupled snaps from moving too far apart such that the hooks 86 and 88 could be dislodged from the bill 30.

While all of the above description refers to male snap portions 82 and 84 being mounted temporarily on the bill 30, it will be understood that other fasteners could be temporarily mounted on the bill 30. For example, the female portions 32 and 34 of the snap could be placed on the cap 36, but such configuration is not preferred. When a different fastener system is used on the cap 36, of course, a corresponding fastener system would be used on the hood 20. One example of a different type of fastener would be a Velcro fastener temporarily mounted on the cap 36 and permanently mounted on the hood 20. However, snaps have distinct advantages over Velcro and snaps are preferred.

Figure 16:
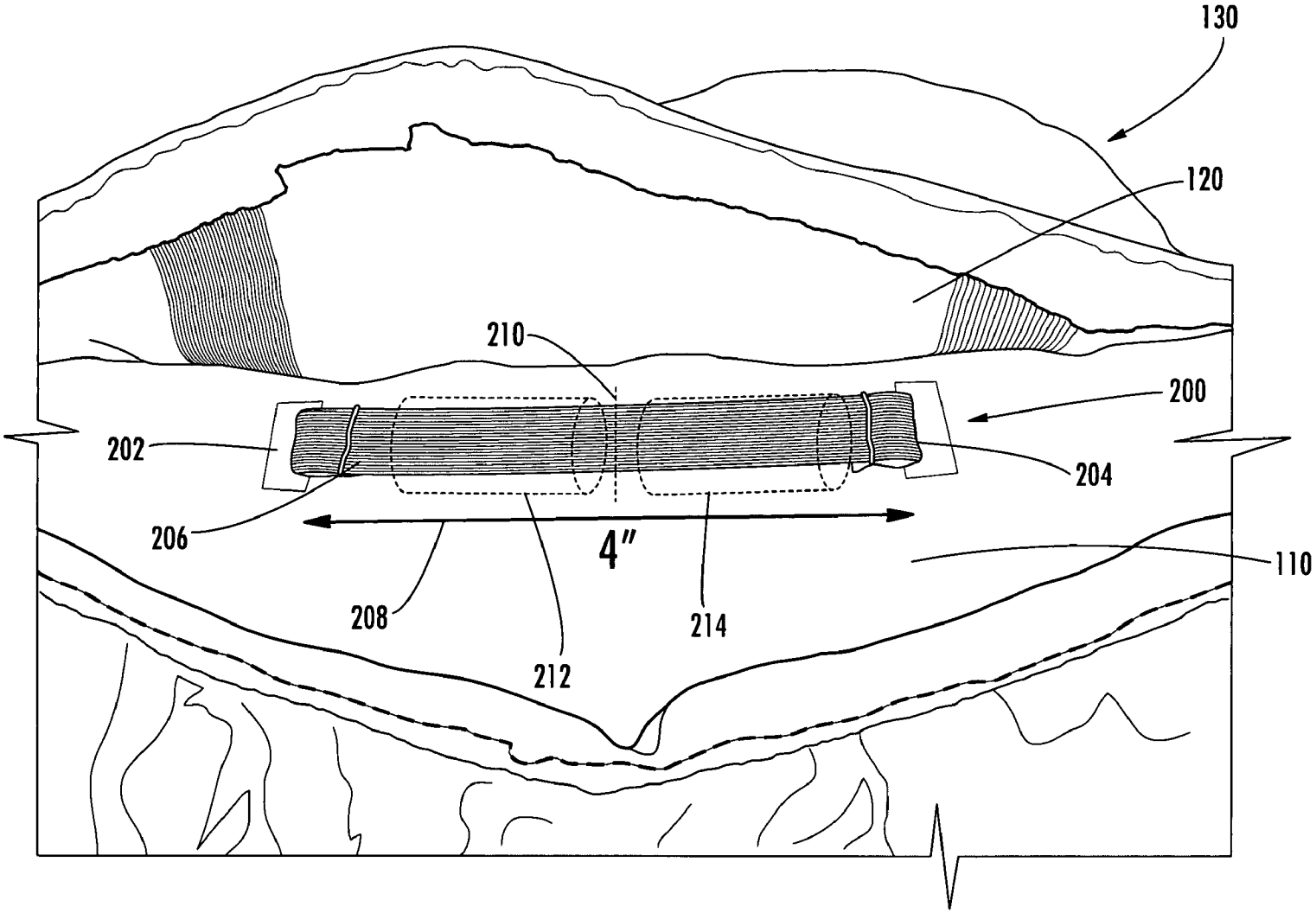
FIG. 16 is a view inside the two pieces of fabric comprising the hood showing the elastic strip and the rest of the permanent attachment system and corresponding holes for the elastic strip.
Figure 17:
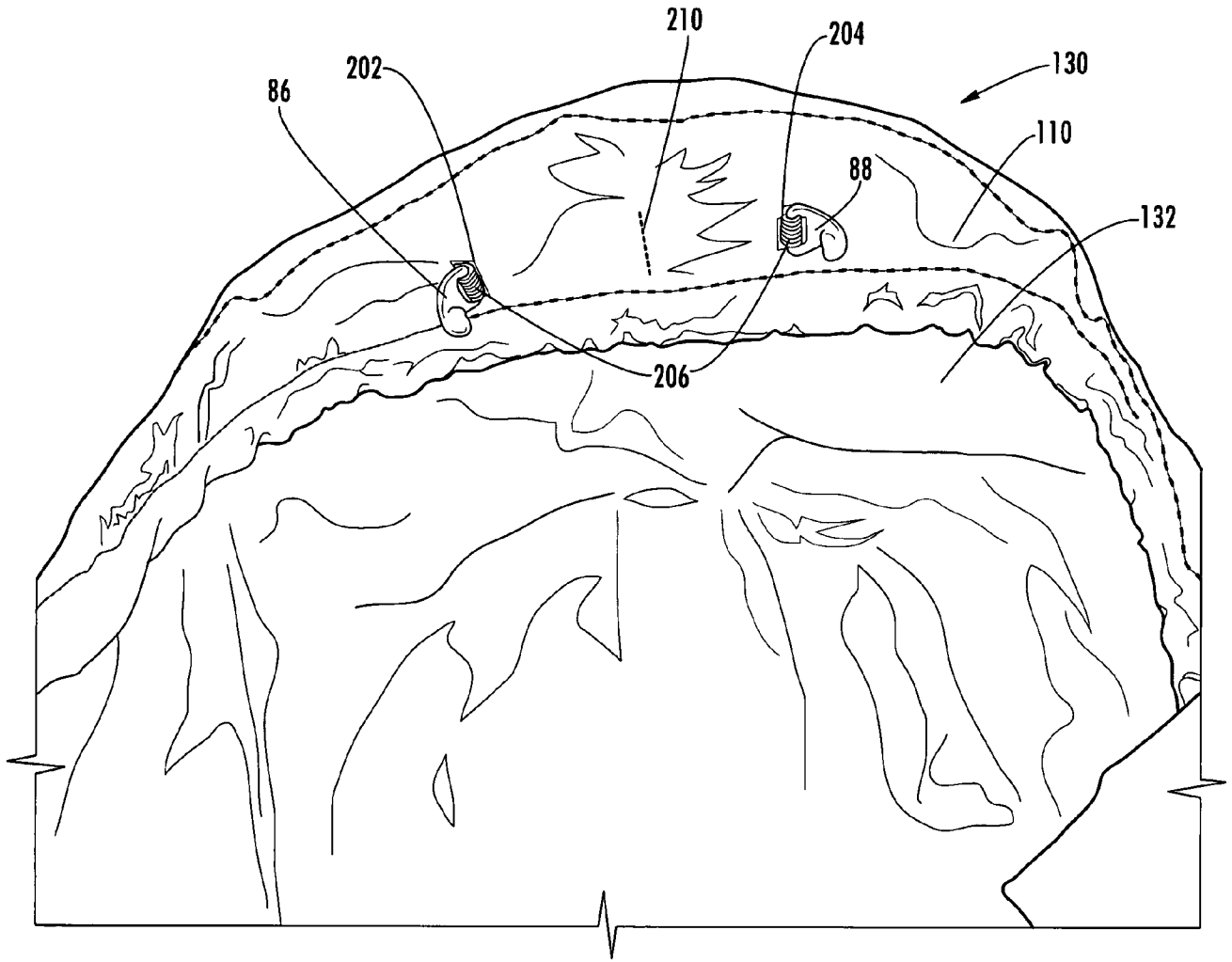
FIG. 17 is a view of the interior of the hood including the permanent attachment system.

FIGS. 16 and 17 demonstrate another embodiment of the invention comprising a permanent fastening system 200 located predominantly in-between two layers 110 and 120 of the hood 130 of the jacket 22. In FIG. 16 a view of the area between the inner piece 110 of the hood 130 and the outer piece 120 of the hood 130 is shown. The two pieces 110 and 120 are normally sewn together, but pieces 110 and 120 are shown torn apart in FIG. 16 to reveal the space between the pieces 110 and 120. This view is useful in showing the permanent fastening system 200, which is comprised of an elastic strip 206 threaded through a first hole 202 and a second hole 204 in the inner piece 110 of the hood 130. As shown on the figure at 208, the distance between the holes 202 and 204 in this embodiment is about four inches.

FIG. 17 shows the inner piece 110 of the hood 130 forming part of the underside 132 of the hood 130. Protruding through the underside 132 of the hood 130 at holes 202 and 204 is the permanent fastening system 200. Each far end of the elastic strip 206 slightly projects from the holes 202 and 204, and hooks 86 and 88 are attached to the ends of the elastic strip 206. The hooks are configured and positioned such that they may attach to the bill 30 of a cap 36. Preferably, but optionally, the hooks are situated to secure the cap 36 to the hood 130 such that the cap 36 is in the middle of the hood 130. This is accomplished by placing a line of stitching 210 at the midpoint between the two holes 202 and 204. The line of stitching 210 anchors the elastic strip 206 and thus the entire permanent fastening system 200. The sturdiness provided by the line of stitching 210 ensures that the elastic strip 206 does not slide and become misplaced toward either hole 202 or 204 and removes the possibility of uneven coupling between the cap 36 and the hood 130.

Furthermore, the line of stitching 210 secures the elastic strip 206 to the inner piece 110 of the hood 130 without passing through the outer piece 120 of the hood 130. This allows for the outside piece 120 of the hood 130 to remain clean from blemishes such as stitching and snaps. The entire permanent fastening system 200 lies hidden below the outer piece 120 of the hood 130 and therefore further contributes to the clean appearance of the hood 130.

In another embodiment shown in FIG. 16, sleeves 212 and 214 may envelope the elastic strip 206 such that the elasticity of the strip 206 does not cause bunching of the hood 130. The sleeves 212 and 214 are preferably two components 212 and 214 separated at the midpoint of the elastic strip 206 by the line of stitching 210. In an alternate embodiment, a single sleeve may be used instead of the two sleeves 212 and 214.

In many applications, the sleeves 212 and 214 will not be required because the elastic strip 206 will be configured and dimensioned to avoid significant bunching of the hood 130, but in demanding applications, the sleeves 212 and 214 are useful.

In this embodiment of the permanent fastening system 200, tension pulls the hooks 86 and 88 toward the midpoint of the elastic strip 206 such that the hooks 86 and 88 may clasp onto a cap 36 without bunching the hood 130. Preferably, the elastic strip 206 would be narrow in width and the hooks 86 and 88 would be of sufficient size to resiliently clasp onto the bill 30 of a cap 36 and no larger. This allows for the permanent fastening system 200 to remain un-bulky and compact. The un-stretched length of the elastic strip 206 is preferably smaller than the average width of the bill 30 of a small-sized cap 36, and the stretched length of the elastic strip 206 should be sufficient to fit over a large-sized cap in the commercial market. Also, when attached to a cap 36 of any size, the elastic strip 206 would preferably have sufficient tension to secure the hood 130 to the cap 36 as a wearer turns his or her head.

In another embodiment two elastic strips may be used and may be secured on the inner piece 110 of the hood 130 near the midpoint between the holes 202 and 204. Or, a non-elastic strip 206 (or strips) may be used, in which case the hooks 86 and 88 preferably resiliently clasp onto the bill 30 of the cap 36. Such non-elastic strip 206 may be sized to fit larger bills 30, but small enough to allow only a small amount of play in the connection between the cap 36 and hood 130. This small "play" does not interfere with the function of turning the hood 130 in unison with the user's head to maintain unobstructed vision.

While preferred embodiments have been described above, it will be understood that the invention is capable of numerous arrangements, modifications and substitutions of parts without departing from the spirit of the invention.

What is claimed is:

1. A head covering system comprising:

a hood configured to fit over a head of a user and to protect top, first, and second sides of the head;

a cap for engaging the head of the user and moving with the head of the user; and a fastening system for fastening the hood to the cap and for fastening at a proximal fastening location that is proximate to the head of the user so that the hood moves with the head of the user with a reduced twisting force on the head because of the proximal fastening location as compared to fastening the hood to the cap at a position less proximate to the head of the user;

wherein the cap is a cap having a skull covering portion and a bill extending from the skull covering portion, the bill having at least a base edge proximate the skull covering portion, two lateral edges extending away from the base edge, and forward edge disposed distally from the base edge;

the fastening system comprises an elastic strap having first and second ends and a midsection between the ends, wherein the strap is attached at the midsection to the top portion of the hood; and the fastening system includes hooks disposed on the ends of the strap, said elastic strap and hooks being configured and positioned to hook the lateral sides of the bill such that the two hooks stretch the elastic strap in a position crossing the bill, whereby the hood is fastened to the cap.

* * * * *